US007843479B2

(12) United States Patent
Spinelli et al.

(10) Patent No.: US 7,843,479 B2
(45) Date of Patent: Nov. 30, 2010

(54) METHOD FOR PROVIDING A PLURALITY OF LASER-PRINTED LABELS FROM A MEDIUM SUPPORTED ON A DISC

(75) Inventors: Luis A. Spinelli, Sunnyvale, CA (US); Mark M. Gitin, Mountain View, CA (US)

(73) Assignee: Coherent, Inc., Santa Clara, CA (US)

( * ) Notice: Subject to any disclaimer, the term of this patent is extended or adjusted under 35 U.S.C. 154(b) by 28 days.

(21) Appl. No.: 12/252,474

(22) Filed: Oct. 16, 2008

(65) Prior Publication Data

US 2010/0097436 A1 Apr. 22, 2010

(51) Int. Cl.
*B41J 2/435* (2006.01)

(52) U.S. Cl. ..... 347/224

(58) Field of Classification Search ..... 347/224, 347/225

See application file for complete search history.

(56) References Cited

U.S. PATENT DOCUMENTS

| | | | | |
|---|---|---|---|---|
| 5,236,535 | A * | 8/1993 | Smith | 156/250 |
| 5,317,337 | A | 5/1994 | Ewaldt | 346/1.1 |
| 5,500,924 | A | 3/1996 | deSilva et al. | 395/129 |
| 5,833,274 | A * | 11/1998 | Schmidt | 283/67 |
| 5,837,337 | A * | 11/1998 | Schnitzer | 428/40.1 |
| 6,313,436 | B1 | 11/2001 | Harrison | |
| 6,852,948 | B1 | 2/2005 | Harrison | |
| 7,154,523 | B2 | 12/2006 | Bronson | 347/224 |

* cited by examiner

*Primary Examiner*—Hai C Pham
(74) *Attorney, Agent, or Firm*—Morrison & Foerster LLP

(57) ABSTRACT

A method of printing labels includes supporting a laser sensitive material on a disc and printing label images on the disc with a modulated focused beam from a diode-laser. The label images may be printed in regions of the medium having pre-cut label boundaries. Alternatively, label boundaries may be cut through the medium using the focused laser beam. The labels are peeled from the disc after printing.

20 Claims, 5 Drawing Sheets

METHOD FOR PROVIDING A PLURALITY OF LASER-PRINTED LABELS FROM A MEDIUM SUPPORTED ON A DISC

TECHNICAL FIELD OF THE INVENTION

The present invention relates in general to label printers. The invention relates in particular to laser printers systems wherein the printing is effected by a beam from a diode-laser.

DISCUSSION OF BACKGROUND ART

Laser marking systems are now in common use for marking materials such as metals, glass, wood, and plastic. Lasers used in such marking systems include diode-pumped solid-state lasers, fiber-lasers, and carbon dioxide ($CO_2$) lasers. Typically a beam from whatever laser is used in the system is steered by a two-axis galvanometer and focused by f-theta optics onto a surface of an object being marked.

Special materials have been developed, and are commercially available, for accepting laser radiation to allow high-speed, high-volume, writing of labels with a laser marking system. One such material is "Laser Markable Label Material 7847" available from 3M Corporation of Minneapolis, Minn. This material is a three-layer polymer laminate material having a white base film with a black surface coating to facilitate absorption of laser radiation. The white base film becomes exposed when the black material is ablated away by laser radiation. The base film is backed by an adhesive layer. A paper liner supports the laminate which can be peeled off when the label is to be applied to the product. The white material can be laser-cut to define the bounds of the label and allow such peeling. Other materials include metallic sheets and foils having an adhesive backing. One such material is AlumaMark® available from Horizons Incorporated, Cleveland, Ohio.

Even the least expensive laser marking system designed for this label material has a cost about two orders of magnitude greater than a computer peripheral paper-label printer such as an inkjet printer, which puts such a system beyond the means of the majority of householders or hobbyists. This is somewhat unfortunate as such a system does not require periodic replacement of inkjet cartridges or toner cartridges and will function until the laser eventually fails, which may only be after tens of thousands of hours of actual use. There is a need for a significant reduction in the cost of laser marking systems for label printing and the like.

SUMMARY OF THE INVENTION

The present invention is directed to apparatus and a method for laser printing of labels. In one aspect of the present invention, a method of printing a label on a medium sensitive to laser radiation, comprises supporting the medium on a disc. The disc is placed on a disc-drive arranged to rotate the disc about an axis of rotation in a rotation direction. A laser print-head is translated across and above the disc transverse to the rotation-direction. The print-head includes a diode-laser arranged to emit a beam of radiation, and focusing optics arranged to focus the beam of radiation on the medium. An image is printed on a portion of the medium using the focused laser beam cooperative with one combination of translation and rotation of the disc. The portion of the medium with the image thereon is then removed from the disc.

In one embodiment of the invention, the medium supported on the disc substantially covers the disc and has a plurality of pre-cut label boundaries therein, each of which defines a portion of the medium on which the image is to be printed such that those portions of the medium can be removed from the disc as separate individual labels leaving the remaining medium on the disc.

In another embodiment of the invention there are no pre-cut label boundaries on the medium and the method further includes the step of scribing through the medium using the focused laser beam cooperative with another combination of translation and rotation of the disc to laser cut label boundaries. This can be done before or after images are printed. This allows different sized labels to be printed on a single disc. The label dimensions can be tailored to suit the label content or an object to be labeled.

BRIEF DESCRIPTION OF THE DRAWINGS

The accompanying drawings, which are incorporated in and constitute a part of the specification, schematically illustrate a preferred embodiment of the present invention, and together with the general description given above and the detailed description of the preferred embodiment given below, serve to explain principles of the present invention.

DETAILED DESCRIPTION OF THE INVENTION

Figure 1:
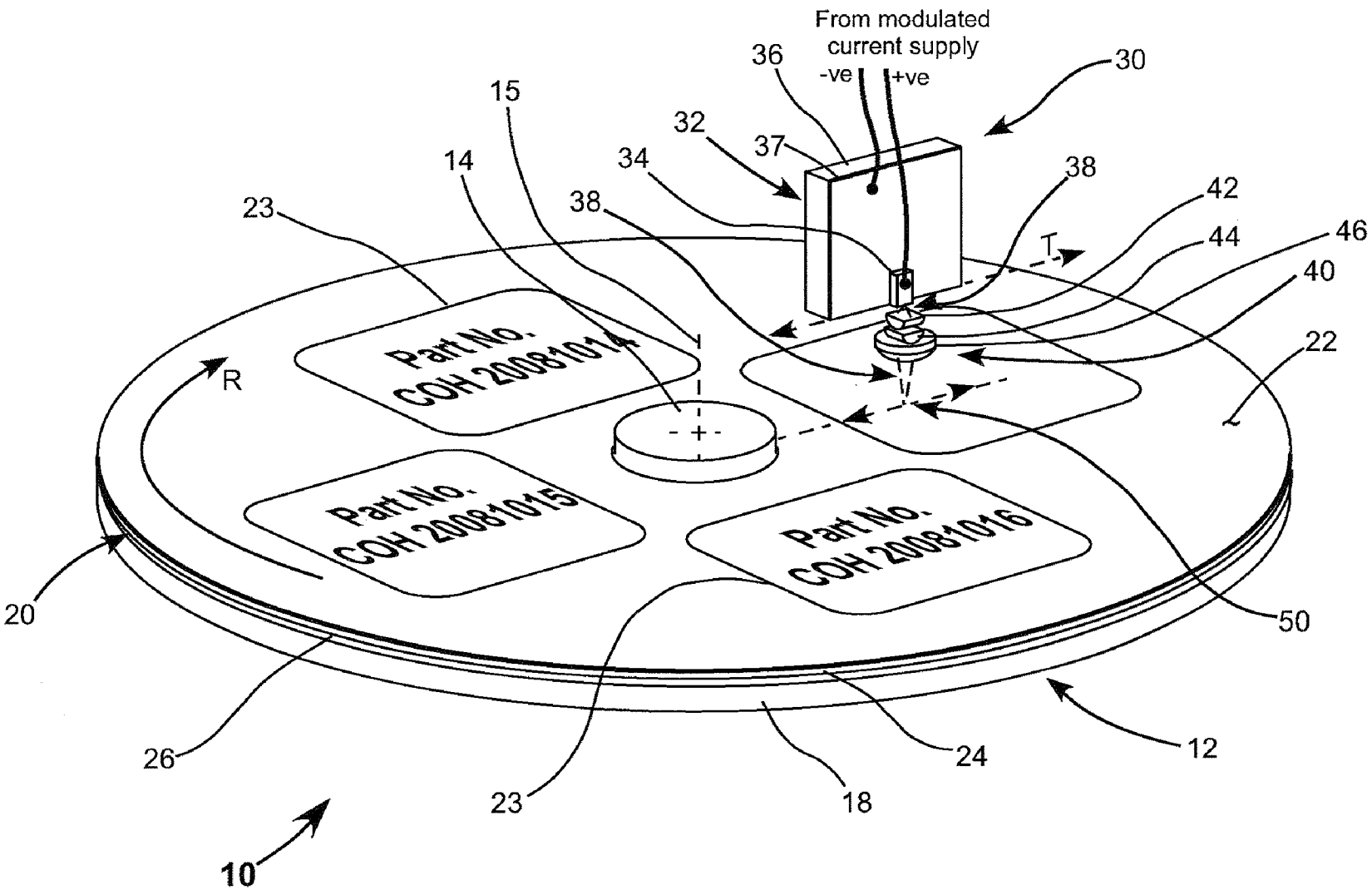
FIG. 1 is a three-dimensional view schematically illustrating one preferred embodiment of laser label printing apparatus in accordance with the present invention including a laser-sensitive printing medium supported on a rotatable disc and having a plurality of pre-cut label boundaries therein, a printing head including a diode-laser for providing laser radiation and projection-optics for focusing the laser radiation on the printing medium, the printing head being translatable above and over the disc in a direction transverse to a rotation direction of the disc.
Figure 1A:
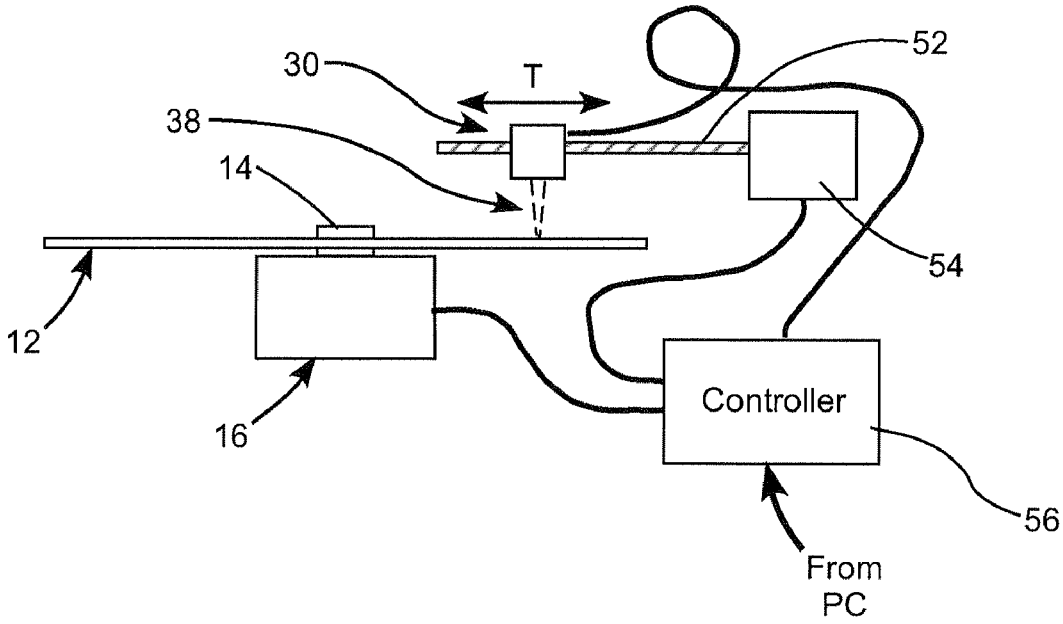
FIG. 1A is an elevation view schematically illustrating one arrangement for translating the printing head in the apparatus of FIG. 1.
Figure 1B:
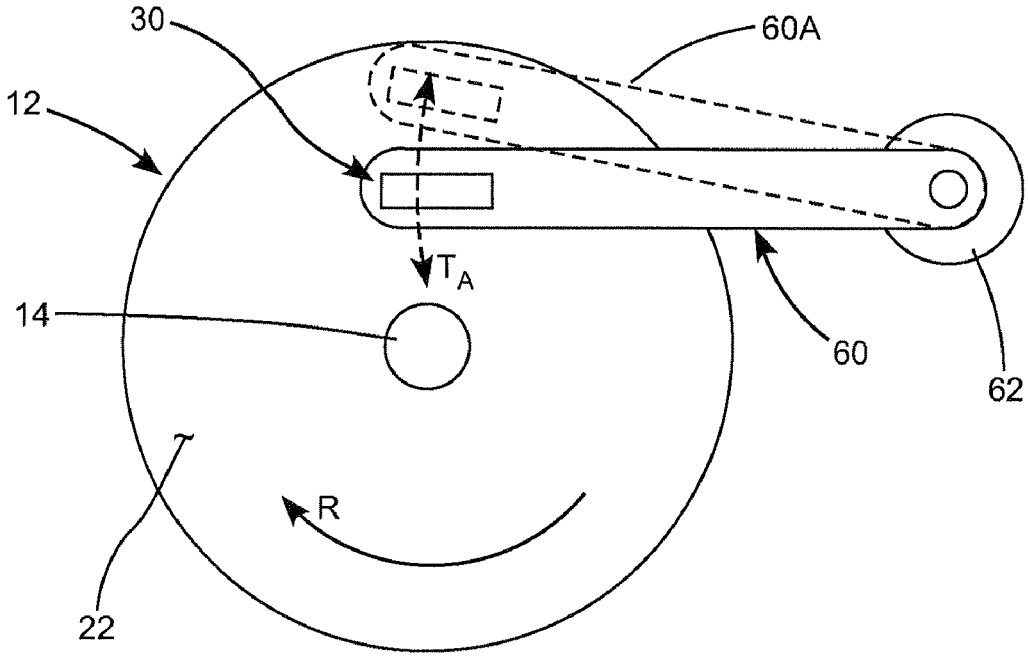
FIG. 1B is plan view from above, schematically illustrating another arrangement for translating the printing head in the apparatus of FIG. 1.

Referring now to the drawings, wherein like components are designated by like reference numerals, FIG. 1, FIG. 1A, and FIG. 1B schematically illustrate one preferred embodiment 10 of laser marking apparatus in accordance with the present invention. Referring in particular to FIG. 1, apparatus 10 is configured for printing label images on a unit 12 including a laser sensitive medium 20 supported on a disc 18. Medium 20 is similar to the 7847 material discussed above. Medium 20 includes an uppermost laser sensitive printing layer 22 of one color backed by a layer 24 of a contrasting color. By way of example layer, 22 may be black, for optimizing absorption of laser radiation, in which case layer 24 is preferably white or yellow. Layer 24 is backed by a layer 26 of an adhesive which here attaches the medium to the surface of disc 18. The adhesive layer bond to layer 24 is stronger than the bond to disc 18. This provides that the medium can be peeled from the disc with the adhesive layer still part of the medium. In this instance a plurality, here four, of the label boundaries are pre-cut into the medium and extend into adhesive layer 26. Label information is written by the apparatus within these boundaries. The information can include graphic images or alphanumeric characters. Only characters are shown here for convenience of illustration.

The disc is mounted on a hub 14 of a disc drive 16 (see FIG. 1A) which rotates the disc about a rotation-axis 15 as indicated in FIG. 1 by arrow R. Printing is done by a print-head 30 which including a diode-laser assembly 32 and focusing optics 40. The print-head is translatable back and forth over and above the disc as indicted in FIGS. 1 and 1A by arrow T. The translation-direction is transverse to the rotation-direction.

Those skilled in the art will recognize that several options are available for providing translation of the print-head. By way of example, FIG. 1A schematically depicts translation of print-head 30 by a lead-screw 52 driven by a motor 54. In this arrangement, the translation is linear and parallel to a radius extending from the axis of rotation 15 of the disc. FIG. 1B schematically depicts translation of the print head by a swing arm 60 driven by a motor 62. In this arrangement the translation-direction of the print-head is slightly arcuate as indicated by arrow $T_A$ (and by arm 60 in a position indicated by dashed line 60A) but, nevertheless, is still transverse to the rotation-direction of the disc.

Referring again to FIG. 1, diode-laser assembly 32 of print-head 30 includes an edge-emitting semiconductor heterostructure (emitter) 34 on an insulating sub-mount 36. The sub-mount has a metallization layer 37 thereon to which the emitter is soldered. A heat-sink for cooling the sub-mount is preferably provided, as is known in the art, but is not shown here for simplicity of illustration.

Emitter 34 emits a diverging beam 38. The beam has a divergence in the fast-axis of the emitter at an angle of about 30° measured across the FWHM intensity points of the beam. Divergence in the slow-axis (perpendicular to the fast axis) is about 10°. These divergences should not be construed as limiting the present invention. Beam 38 is intercepted by projection-optics 40. Optics 40 include a cylindrical fast-axis collimating lens 42, a cylindrical slow-axis collimating lens 44, and a focusing lens 46 which focuses beam 38 into a focal spot 50 on printing layer (uppermost layer) 22 of the medium.

Diode-laser 34 is driven by current from a modulatable current supply. The modulation can be programmed, for example from a computer-generated bit-map image, in cooperation with some combination of translation of the print head and rotation of the disc. Methods for printing computer-generated images and characters sheets and discs using modulated ink jets or lasers are well known in the art to which the present invention pertains and a detailed of any such methods is not required for understanding principles of the present invention accordingly only a brief discussion of such methods applied to apparatus 10 is set forth below.

In one method of operation, printing could take place with the disc stationary and the print-head translating to form one row of an image. The disc could be rotated incrementally and another row of the image printed by translation of the head, with disc incrementing and print-head translation being repeated until printing was complete. In another method of operation the disc could be rotated with the print-head stationary to print one row of an image on part of a circular path on the disc. The print-head could then be incrementally translated and the disc rotated to print another row of the image on part of a parallel circular track, with the print-head incrementing and disc rotation being repeated until printing was complete. In yet another mode of operation, rotation of the disc and translation of the print-head may be performed simultaneously to print (or draw) in a vector fashion.

It is possible to modulate diode-laser 34 regularly in combination with above described motions such that a printed image consists of a plurality of marks (pixels) of the same size but different spatial density corresponding to a computer bit-map image. It can be more economical of time and rotation and translation motions, however, to print in lines of different length, in essence joining all pixels of a portion of a dark area together. In this way laser is turned on at the beginning of a line and turned off at the end of a line instead of being turned on and off at a fixed modulation rate several times along the line. Such a technique is described in the context of a graphics (ink pen) plotter in U.S. Pat. No. 5,500,924 the complete disclosure of which is hereby incorporated by reference. This technique is based on well-known data compression techniques.

Figure 2:
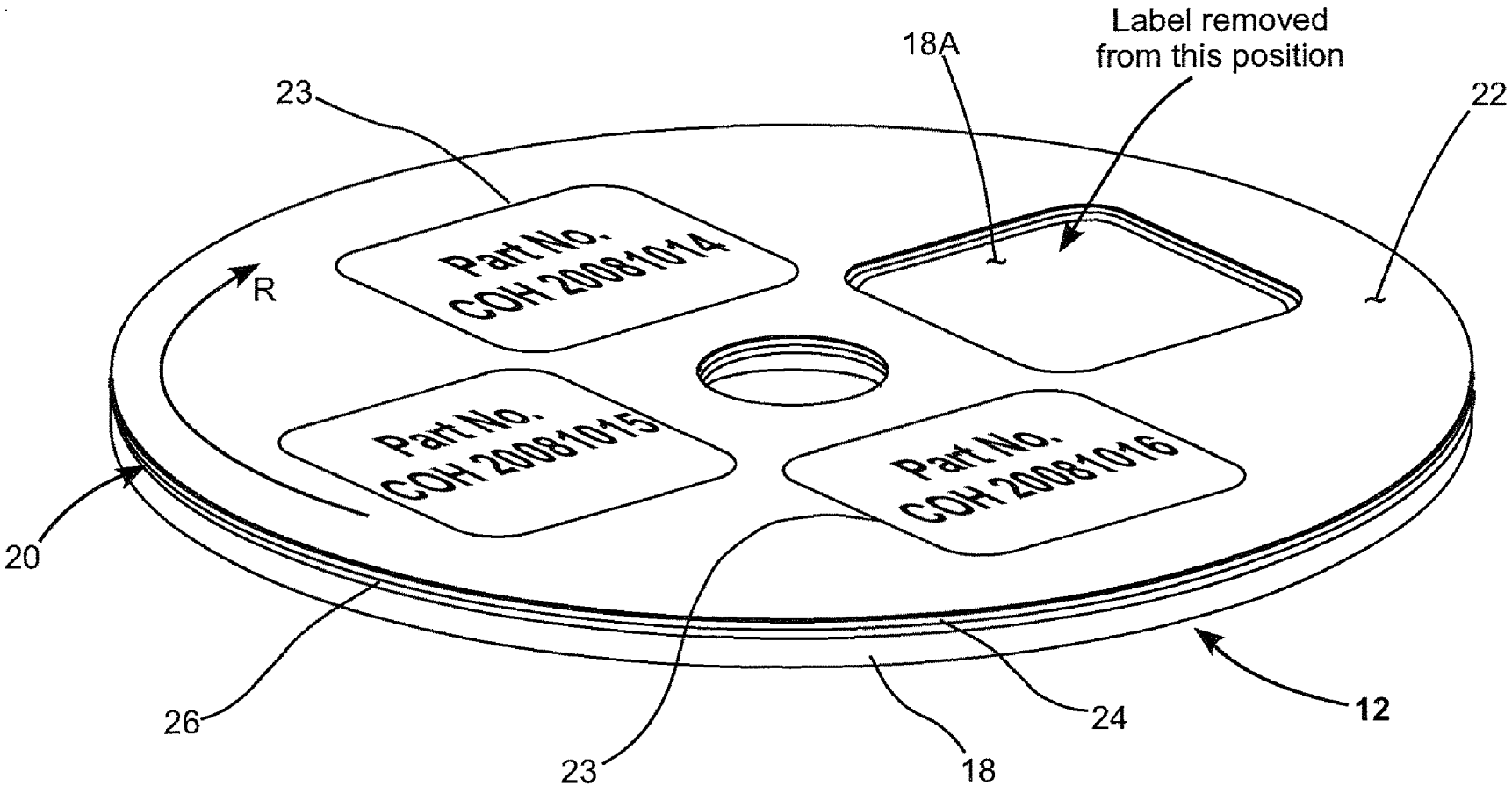
FIG. 2 is a three dimensional view schematically illustrating the disc-supported medium of FIG. 1 removed from the apparatus with one label removed from the medium on the disc.

Referring again to FIG. 1A, whatever method is selected, a controller 56 receives instructions from a personal computer including software that designs a label image and translates the image into instructions appropriate to the selected printing method. The controller then controls the diode-laser motor 16, and motor 54 in accordance with the computer-provided instructions to reproduce the computer-generated image on the disc. Referring now to FIG. 2, when a desired number of labels have been printed on medium 20 the disc with the medium thereon is removed from the disc-drive and the printed labels are peeled individually from the disc (facilitated by the pre-cut label boundaries) leaving the remaining medium on the disc. In an area where the label has been removed surface 18A of the disc is exposed.

It should be noted, here, that images (here characters) on printed labels are depicted in FIG. 1 as a being black on a white background for convenience of illustration. Using the 7847 multilayer medium described above, the mark would actually appear as a white mark on a black background. The upper layer is ablated away by the laser only as far as the backing layer. The color of the backing layer is the color of the image and the color of the upper layer is the color of the background.

In a calculated example of apparatus 10, it was assumed that medium 20 was the 7847 tape discussed above, and that emitter 14 emitted between about 5.0 and 10.0 Watts (W) in a beam 38 having a fast-axis divergence (at FWHM) of about 29°. It was determined experimentally that that maximum linear marking speed was about 500 millimeters per second (mm/sec). The focused beam was assumed to have dimensions of between about 10 and 20 micrometers (μm) by about 90 μm. This translates to a marking resolution of about 250 dots per inch (dpi). Given these assumptions, it is estimated that about one-minute would be required to mark a label about 2.5 inches square.

While the method of the present invention is described in terms of printing label images on a medium in which label boundaries have been pre-cut, it is also possible to use a medium that does not include pre-cut label boundaries and use the apparatus to provide label boundary cuts in the medium. This can be done before or after label information is printed. An advantage of this method is that different sized labels can be made on the same disc. The label size can be tailored to correspond to the information content of the label or to be appropriate for an object to which the label will be attached. Labels having arbitrary decorative edges such as scalloped edges can be produced.

In order to do such label-boundary cutting it is necessary to ablate through the medium, into and preferably through the adhesive layer. It is preferable for cutting to use a combination of rotation of the disc and translation of the print-head (now functioning as a cutting-head) for driving the print-head in a vector fashion with the diode-laser turned on from the beginning of a label-boundary cut to the end of the label-boundary cut. Because of the ablation depth required, the linear speed of the printer head along the vectored track must be slower than the maximum possible writing speed. This, of course, is tolerable due to the fact that the area of the boundary cut will usually by considerably less than the area of a printed image or information.

Figure 3:
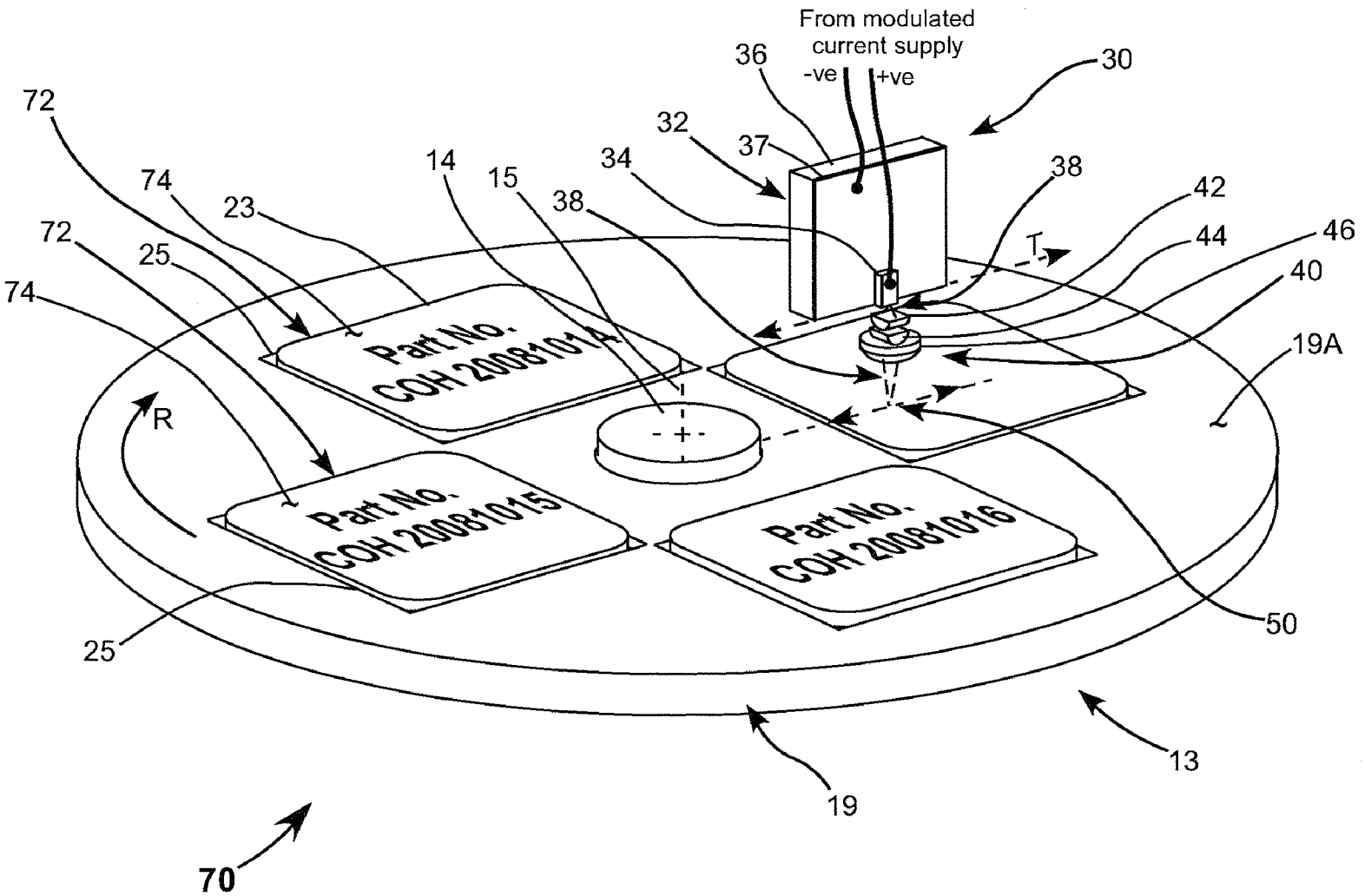
FIG. 3 is a three-dimensional view schematically illustrating another preferred embodiment of laser label printing apparatus in accordance with the present invention including a laser sensitive labels supported in recesses on a rotatable disc a printing head including a diode-laser for providing laser radiation and projection-optics for focusing the laser radiation on the labels, the printing head being translatable above and over the disc in a direction transverse to a rotation direction of the disc.
Figure 4:
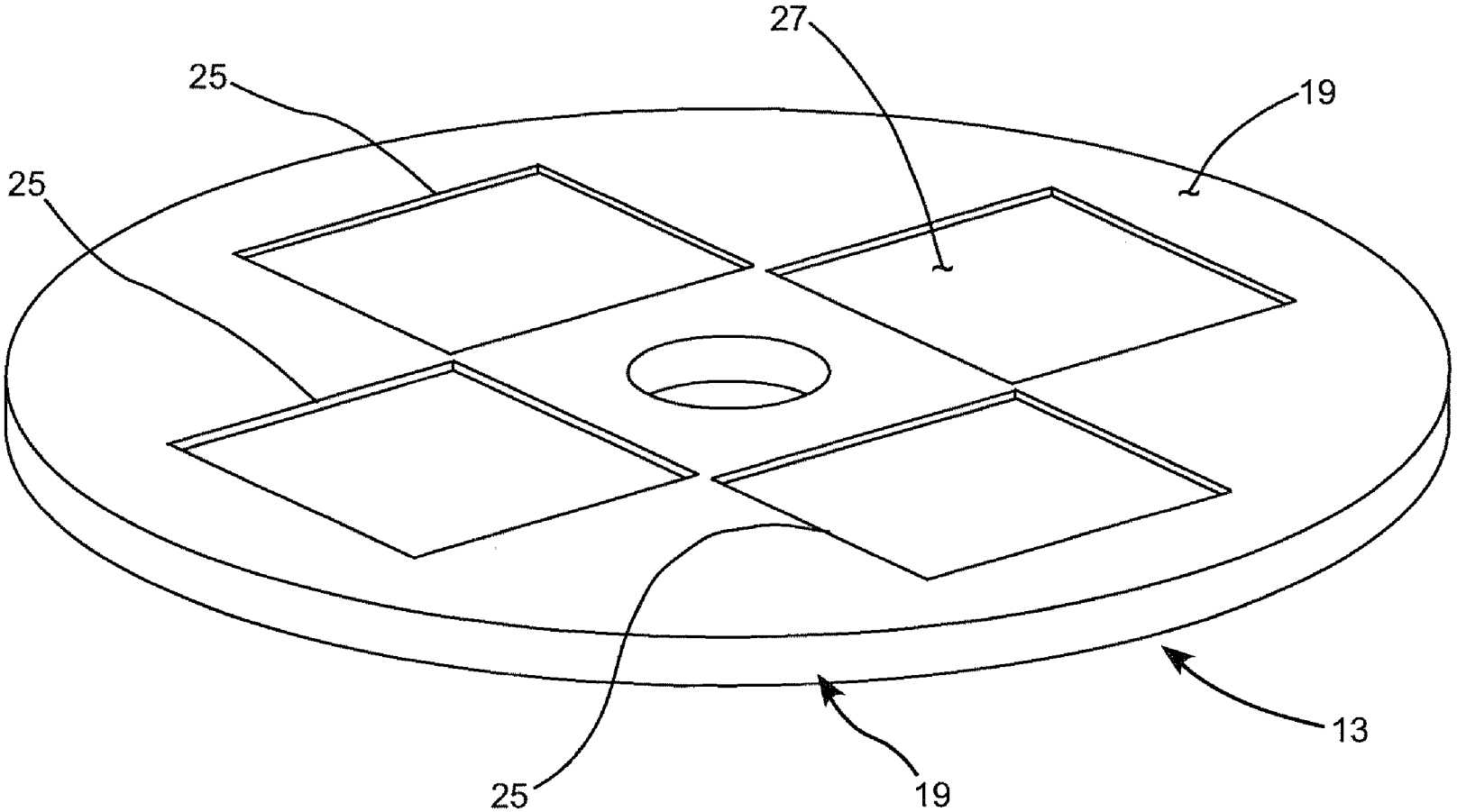
FIG. 4 is a three-dimensional view schematically illustrating details of the disc and recesses therein in the apparatus of FIG. 3, with the labels removed.

FIG. 3 and FIG. 4 schematically illustrate another preferred embodiment 70 of laser marking apparatus in accordance with the present invention. Apparatus 70 is similar to apparatus 10 of FIG. 1, with an exception that unit 12 of apparatus 10 including the laser sensitive medium supported on a disc is replaced in apparatus 70 by a disc 19 having recesses 25 in surface 19A thereof, with precut labels 72 located in the recesses. Labels 72 have a laser sensitive surface (or surface layer) 74. The base 27 of the recesses (see FIG. 4 is preferably covered with a non-hardening adhesive that allows the labels to be removably attached to the base of the recesses. Printing of the labels may be carried out by any of the schemes described above. After the labels are printed, the labels are removed from the recesses in the disc.

Apparatus 70 is particularly suited for printing on semi-rigid pre-cut black-anodized aluminum labels having a thickness that does not make laser cutting of sheet-stock practical in low-power apparatus, for example, in apparatus having only a single diode-laser usable for cutting. The use of other media, such as the 7847 multilayer polymer, however, is not precluded. It should be noted that if relatively heavy labels, such as anodized aluminum labels are used, operating a disc with less than all of the recesses having a labels therein, or with different sized labels in the recesses may create imbalance problems if the disc is rapidly rotated.

Those skilled in the art will recognize that for any of the apparatus and operational methods described above, means may be provided for monitoring the position of the printing (or cutting) beam, or for detecting fiducial marks pre-printed on the medium to aid in optimally locating labels on a disc. Such means would be particularly useful if a label printed on a disc were needed before the available printing area of the disc was used, as it would allow a partially used disc to be reinserted in the apparatus and allow the apparatus to locate printable areas of the medium. Here again however, imbalance problems may occur if a partially used disc is rapidly rotated. Such fiducial-marking and reading means are well known in the art to which the present invention pertains and may be used in conjunction with above described label writing and cutting methods without departing from the spirit and scope of the present invention.

In summary, the present invention is described above in terms of a preferred and other embodiments. The invention is not limited, however, to the embodiments described and depicted. Rather, the invention is limited only by the claims appended hereto.

What is claimed is:

1. A method of printing a label on a medium sensitive to laser radiation, comprising the steps of:

supporting the medium on a disc;

placing the disc on a disc-drive arranged to rotate the disc about an axis of rotation in a rotation direction;

translating a laser print-head across and above the disc transverse to the rotation-direction, the print-head including a diode-laser arranged to emit a beam of radiation and focusing optics arranged to focus the beam of radiation on the medium;

printing an image on a label portion of the medium using the focused laser beam cooperative with a combination of translation of the print head and rotation of the disc; and removing the label portion of the medium with the image thereon from the disc.

2. The method of claim 1, wherein the medium supported on the disc has a plurality of pre-cut label boundaries one of which defines the portion of the medium on which the image is printed such that the label portion of the medium can be removed from the disc.

3. The method of claim 1, wherein the method further includes the step of scribing through the medium using the focused laser beam cooperative with another combination of translation of the print head and rotation of the disc to isolate the label portion of the medium from the remainder of the medium such that the label portion of the medium can be removed from the disc.

4. The method of claim 3, wherein the scribing step is performed before the printing step.

5. The method of claim 3, wherein the scribing step is performed after the printing step.

6. A method of printing labels, comprising the steps of:

supporting a medium sensitive to laser radiation on a disc, the medium having an adhesive backing layer for removably retaining the medium on the disc, the adhesive layer having a stronger bond to the medium than to the disc;

the medium having a plurality of label regions defined therein by a corresponding plurality of circumscribing cuts through the medium into the adhesive layer thus allowing any circumscribed label region of the medium with a corresponding portion of the adhesive layer thereon to be removed from the disc without disturbing the remainder of the medium on the disc;

placing the disc with the medium thereon on a disc-drive arranged to rotate the disc about an axis or rotation in a rotation direction;

translating a laser print-head across and above the disc in a direction transverse to the rotation direction, the print-head including a diode-laser arranged to emit a beam of radiation and focusing optics arranged to focus the beam of radiation on the medium;

printing an image on at least one label region of the medium using the focused laser beam cooperative with one combination of translation of the print head and rotation of the disc; and removing the at least one label region of medium and adhesive layer from the disc.

7. The method of claim 6, wherein the medium has upper and lower sub-layers having respectively first and second colors, the first and second colors being contrasting colors, and wherein the image is printed by ablating portions of the upper sub-layer away to expose the lower sub-layer, such that the image has the second color on a background of the first color.

8. The method of claim 6, wherein the combination of rotation of the disc and translation of the laser print-head includes printing a first row of elements of the image by translating the print-head and turning the diode-laser on and off with the disc stationary, incrementally rotating the disc, printing a second row of elements of the image by translating the print-head and turning the diode-laser on and off with the disc stationary, and repeating the incremental rotation and translation until the image is printed.

9. The method of claim 6, wherein the combination of rotation of the disc and translation of the laser print-head includes printing a first row of elements of the image by rotating the disc and turning the diode-laser on and off with the print-head stationary, incrementally translating the print-head, printing a second row of elements of the image by rotating the disc and turning the diode-laser on and off with the print-head stationary, and repeating the rotation and incremental translation until the image is printed.

10. A method of printing labels, comprising the steps of:

supporting a medium sensitive to laser radiation on a disc, the medium having an adhesive backing layer for removably retaining the medium on the disc, the adhesive layer having a stronger bond to the medium than to the disc;

placing the disc with the medium thereon on a disc-drive arranged to rotate the disc about an axis of rotation in a rotation direction;

translating a laser print-head across and above the disc in a direction transverse to the rotation direction, the print-head including a diode-laser arranged to emit a beam of radiation and focusing optics arranged to focus the beam of radiation on the medium;

printing a label image on a region of the medium using the focused laser beam cooperative with a first combination of translation of the print head and rotation of the disc;

circumscribing the region of the medium using the focused laser beam cooperative with a second combination of translation of the print head and rotation of the disc thereby allowing the circumscribed region of the medium with a corresponding portion of the adhesive layer thereon to be removed from the disc without disturbing the remainder of the medium on the disc; and removing the at least one label region of the medium with the label image and the portion of the adhesive layer thereon from the disc.

11. The method of claim 10, wherein the medium has upper and lower sub-layers having respectively first and second colors, the first and second colors being contrasting colors, and wherein the image is printed by ablating portions of the upper sub-layer away to expose the lower sub-layer, such that the image has the second color on a background of the first color.

12. The method of claim 10, wherein the first combination of rotation of the disc and translation of the laser print-head includes printing a first row of elements of the image by translating the print-head and turning the diode-laser on and off with the disc stationary, incrementally rotating the disc, printing a second row of elements of the image by translating the print-head and turning the diode-laser on and off with the disc stationary, and repeating the incremental rotation and translation until the image is printed.

13. The method of claim 10, wherein the first combination of rotation of the disc and translation of the laser print-head includes printing a first row of elements of the image by rotating the disc and turning the diode-laser on and off with the print-head stationary, incrementally translating the print-head, printing a second row of elements of the image by rotating the disc and turning the diode-laser on and off with the print-head stationary, and repeating the rotation and incremental translation until the image is printed.

14. The method of claim 10, wherein the second combination rotation of the disc and translation of the laser print-head includes simultaneously rotating the disc and translating the print-head with the diode-laser turned on.

15. The method of claim 10, wherein the circumscribing of the label region is performed after the label image is printed thereon.

16. A method of printing labels of a medium sensitive to laser radiation, comprising the steps of:

supporting the label on a disc;

placing the disc on a disc-drive arranged to rotate the disc about an axis of rotation in a rotation direction;

translating a laser print-head across and above the disc transverse to the rotation-direction, the print-head including a diode-laser arranged to emit a beam of radiation and focusing optics arranged to focus the beam of radiation on the medium;

printing an image on the label using the focused laser beam cooperative with a combination of translation of the print head and rotation of the disc; and removing the label from the disc.

17. The method of claim 16, wherein the disc has at least one recess therein configured to accommodate the label.

18. The method of claim 17, wherein the base of the recess is coated with an adhesive for releasably attaching the label to the base of the recess.

19. The method of claim 16, wherein the label medium is anodized aluminum.

20. The method of claim 16, wherein the combination of rotation of the disc and translation of the laser print-head includes printing a first row of elements of the image by rotating the disc and turning the diode-laser on and off with the print-head stationary, incrementally translating the print-head, printing a second row of elements of the image by rotating the disc and turning the diode-laser on and off with the print-head stationary, and repeating the rotation and incremental translation until the image is printed.

* * * * *